United States Patent [19]

Sokolowski

[11] 4,429,933

[45] Feb. 7, 1984

[54] CLOSING MECHANISM FOR A CABINET COVER

[76] Inventor: Eugene K. Sokolowski, 2415 N. Oak Park Ave., Chicago, Ill. 60635

[21] Appl. No.: 223,873

[22] Filed: Jan. 9, 1981

[51] Int. Cl.[3] ..... B65D 43/24; E05C 17/32

[52] U.S. Cl. ..... 312/319; 312/325; 312/326; 312/27; 217/60 E

[58] Field of Search ..... 312/319, 325, 326, 329, 312/DIG. 33, 24, 27; 220/335; 292/338, 263; 217/60 E

[56] References Cited

U.S. PATENT DOCUMENTS

| | | | |
|---|---|---|---|
| 254,324 | 2/1882 | Iglehart | 292/263 |
| 773,721 | 11/1904 | Duvall | 312/319 |
| 1,324,601 | 12/1919 | Levanseler | 217/60 E |
| 1,359,953 | 11/1920 | Mandel et al. | 217/60 E |
| 2,353,175 | 7/1944 | Marple | 16/128.1 |
| 2,368,146 | 1/1945 | Kooyman | 220/335 |
| 2,543,485 | 2/1951 | Briggs | 312/325 |
| 2,585,566 | 2/1952 | Lundstrom | 312/325 |
| 2,636,185 | 4/1953 | Boston | 4/251 |
| 2,639,957 | 5/1953 | Geller | 312/319 |
| 2,732,966 | 1/1956 | Schroeder et al. | 292/338 |
| 4,167,298 | 9/1979 | Plattner | 312/319 |
| 4,194,799 | 3/1980 | White | 312/21 |

FOREIGN PATENT DOCUMENTS

| | | | |
|---|---|---|---|
| 54-106400 | 8/1979 | Japan | 292/338 |

*Primary Examiner*—Victor N. Sakran

*Attorney, Agent, or Firm*—J. C. Albrecht; W. K. Serp

[57] ABSTRACT

A closing mechanism 30 for a cabinet cover 14 is described including a pair of elongated flat links 32, 34 joined for sliding pivotal engagement. The remaining end of a first link 34 is pivotally secured to the enclosure cover 14 and the remaining end of the second link 32 is pivotally secured to the cabinet base 12. The links, when in their aligned position, are selectively locked in position by a cooperating notch 44 and tab 56. An articulated biasing means 59 in the form of two articulated coil springs 60, 62 serves to bias the links 32, 34 toward their axially aligned positions thus urging the cover 14 to its open position. The coil springs 60, 62 are hooked together with the remaining end of the second coil spring 62 hooked to a lip 20 on the cabinet base 12 adjacent the cover hinge 16. The remaining end of the first coil spring 60 is hooked to the link 32.

4 Claims, 4 Drawing Figures

CLOSING MECHANISM FOR A CABINET COVER

DESCRIPTION

1. Technical Field

This invention relates to a closing mechanism for a cabinet cover.

2. BACKGROUND ART

Various types of cabinets have been described for housing electronic apparatus such as printers. Often, such cabinets include a concave base wherein a printer is secured and a concave cover secured along one edge to the base by a hinge. This two section cabinet arrangement is particularly desirable in that it facilitates convenient entry into the enclosure for printer servicing. To facilitate such entry, the cover and base sections are generally provided with a mechanism which allows the cover to be secured in its open position. After servicing, the operator releases the mechanism allowing the cover to close. Occasionally, the operator may accidently allow the cover to fall during closure with the cover abruptly dropping onto the base. Such an occurrence may cause damage to the printer housed within the cabinet, or should the operator allow his hand to interfere with the movement of the cover, personal injury could result. Various arrangements have been suggested to retard the movement of the cover during closure. One such arrangement includes a spiral spring which biases the cover to its open position. Although this arrangement is relatively effective, the cost of the device is high. An alternative arrangement utilizes a single elongated coil spring to bias the cover toward its open position. However, once the cover is opened the spring is relaxed and, due to its stiffness, the spring interferes with the full opening of the cover. Often the spring becomes rigid in its relaxed condition and prevents full cover opening or disengages from the closing mechanism. The illustrated closing mechanism provides an economical device which does not interfere with the closure of the cover and which provides an effective retarding force during cover closure.

DISCLOSURE OF THE INVENTION

In accordance with this invention, a closing mechanism is provided for a cabinet having a base and a cover hinged to the base. First and second elongated links are pivotally joined together at their first ends with a second end of the first link pivotally connected to the base of the cabinet and a second end of the second link is connected to the cover. More particularly, an articulated biasing means is coupled to one of the links and to the cabinet. The biasing means has a relaxed condition when the cover is open and an active biasing condition as the cover closes so as to urge the cover to its open condition during closure.

Preferably, the articulated biasing means includes first and second elongated coil springs with a first end of the first coil spring being pivotally connected to a first end of the second coil spring. A second end of the first coil spring is connected to one of the first and second links and a second end of the second coil spring is connected to the base of the enclosure. The linkage includes a first elongated member with a first end of the first elongated member pivotally connected to a first end of a second elongated member. A second end of the first elongated member is pivotally connected to the cover and a second end of the second elongated member is connected to the base of the cabinet.

THE DRAWING

DETAILED DESCRIPTION

Figure 1:
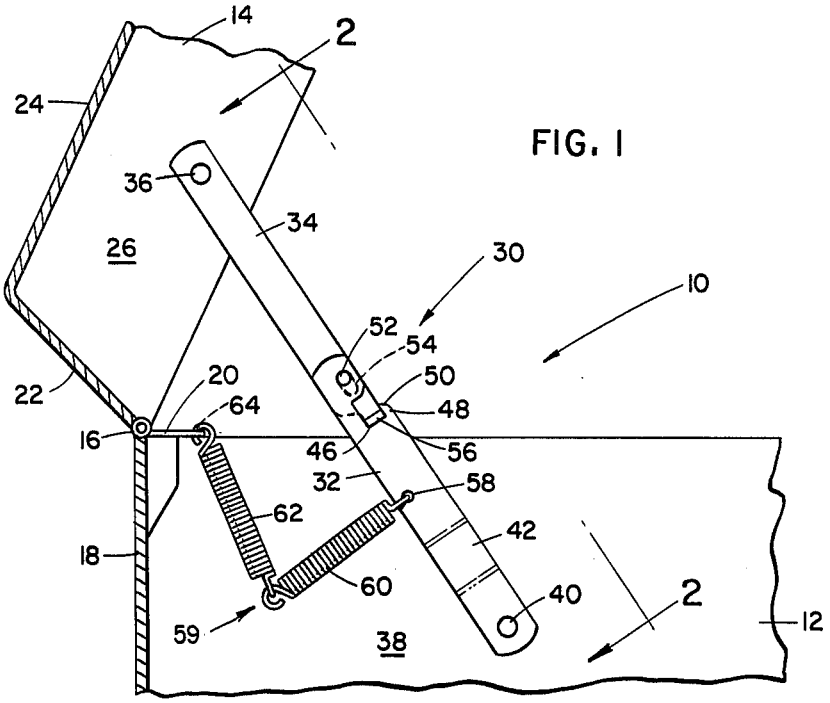
FIG. 1 is a plan view of a closing mechanism in combination with a cabinet with the cabinet cover in an open position.

With reference to FIG. 1, a cabinet 10 is illustrated including a concave base 12 and a mating, concave cover 14 attached along one edge to the base by a hinge 16. The base 12 includes a rear wall 18 and projecting from the rear wall toward the interior of the base 12 is a coextensive, substantially flat lip 20. The cover 14 includes a rear wall 22, a top wall 24 and a pair of side walls 26 only one of which is shown.

Illustrated is a closing mechanism 30 including a pair of rigid links 32, 34. The links 32, 34 are elongated and preferably constructed of flat, rigid material such as steel. Located adjacent the upper end of the link 34 is a circular opening with a pivot pin 36 freely positioned therein.

Figure 2:
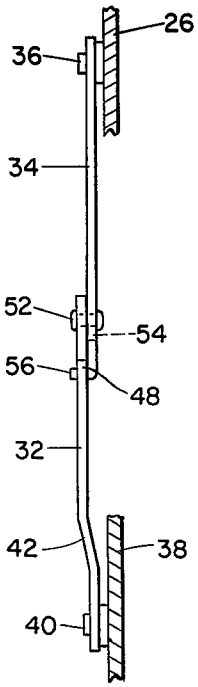
FIG. 2 is a sectional view of the closing mechanism taken along the line 2—2 of FIG. 1.

The pivot pin 36 is secured to the side wall 26 of the cover 14 allowing free pivoting movement of the link 34 with respect to the cover 14. Similarly, the lower end of the link 32 is pivotally mounted to a side wall 38 of the base 12 by a pivot pin 40. As shown in FIG. 2, the lower link 32 is offset as at 42 by a distance equal to the thickness of the material used to fabricate the link 32. This off-set feature assures that the ends of the two links at their pivotal attachments to the cover 14 and base 12 will lie in common plane. This feature allows the wall 38 of the base 12 to lie along a common plane with the wall 26 of the cover 14. As clearly shown in FIG. 3, the link 32 has an open notch 44 located near the upper end of the link 32. The notch 44 is defined by an abutment surface 46 and a locking projection 48. The end of the locking projection 48 defines a slanted camming surface 50. Positioned at the upper end of the link 32 is a hole receiving a hinge pin 52. The lower end of the link 34 has an elongated slot 54 of sufficient size to freely receive the hinge pin 52 for sliding movement therein. As illustrated, the length of the slot 54 is slightly greater than the length of the projection 48. Additionally, the lower end of the link 34 is narrowed and bent over at a right angle to the plane of the link thus defining a locking tab 56. The width of the locking tab 56 is slightly less than the length of the abutment surface 46 thus providing a close fit when the locking tab 56 is seated within the notch 44. Located below the notch on the link 43 is a hole 58 which serves to engage one end of an articulated biasing means 59 in the form of a pair of first 60 and second 62, coupled, elongated coil springs. One end of the first coil spring 60 engages the hole 58 in the link 32 and the remaining end thereof engages one end of the second coil spring 62. The remaining end of the second coil spring 62 is hooked to a hole 64 in the lip 20.

FIG. 1 illustrates the operation of the closing mechanism 30 with the cover 14 in the open position. In this position, the longitudinal axes of the links 32, 34 lie along a common line and the locking tab 56 is securely seated within the notch 44. The weight of the cover 14 is along the longitudinal axes of the links 32, 34 and serves to forcefully hold the links 32, 34 in engagement as shown. In this position, the springs 60, 62 are relaxed and articulated at their common connection allowing them to move to a position which will not interfere with the cover 14 or the links 32, 34.

Figure 3:
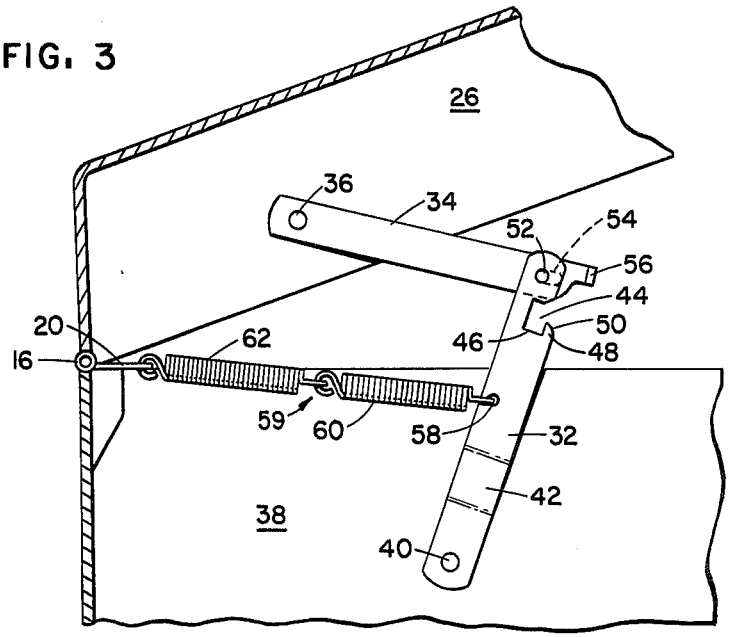
FIG. 3 is a plan view of the cabinet of FIG. 1 with the cover of the cabinet partially closed.
Figure 4:
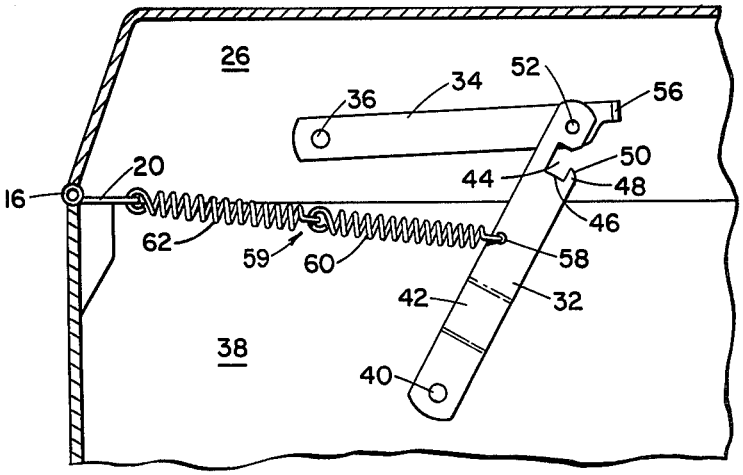
FIG. 4 is a plan view of the cabinet of FIG. 1 with the cover of the cabinet closed.

In FIG. 3, the cover 14 has been raised to allow disengagement of the links 32, 34 and thereafter moved to a partially closed position. In this position, the springs 60 and 62 are partially stretched. As the springs 60, 62 continue to stretch they exert a biasing force urging the links 32, 34 toward their coaxially aligned position. This biasing force counteracts the weight of the cover 14 thus retarding the closure of the cover 14. In FIG. 4, the cover 14 is shown in its fully closed position with the springs 60, 62 fully stretched. The springs 60, 62 are selected so that their biasing force is less than the closing force of the cover 14 thereby assuring that the cover 14 will close under its own weight, but at a slow rate and with reduced force.

Although the invention has been particularly shown and described with reference to a preferred embodiment thereof, it will be understood that various changes in form and detail may be made without departing from the scope and spirit of the invention as defined by the following claims.

What is claimed is:

1. A closing mechanism (30) for a cabinet (10) having a base (12) and a cover (14) hinged to the base (12) wherein first and second elongated links (32, 34) are pivotally joined together at their first ends with a second end of the first link (32) being pivotally connected to the base (12) of the cabinet (10) and a second end of the second link (34) is connected to the cabinet cover (14) comprising:

an articulated biasing means (59) coupled to one of said links (32) and to said cabinet (10) and having a relaxed condition when the cover (14) is open and an active biasing condition as the cover (14) closes to urge the cover (14) to its open condition during closure, and said articulated biasing means (59) includes a first (60) and a second (62) elongated coil spring, a first end of said first coil spring (60) being pivotally connected to a first end of said second coil spring (62), a second end of said first coil spring (60) being connected to one of said first and second links (32) and a second end of said second coil spring (62) being connected to the base (12) of said cabinet (10), whereby said coil springs (60, 62) are relaxed and articulated at their common connection when said cover is open allowing said coil springs (60, 62) to move to a position which will not interfere with said cover (14) or said links (32, 34).

2. The closing mechanism (30) of claim 1 wherein said linkage (34, 32) includes a first elongated member (34) and a second elongated member (32) with a first end of said first elongated member (34) pivotally connected to a first end of said second elongated member (32), a second end of said first elongated member (34) being pivotally connected to said cover (14) and a second end of said second elongated member (32) being pivotally connected to the base (12) of said cabinet (10).

3. The closing mechanism of claim 2 wherein said second end of said coil spring (62) is connected to said cabinet (10) at a location adjacent to the hinge (16) connection of said cover (14) and said base (12).

4. The closing mechanism (30) of claim 3 which further includes means (44, 56) for rigidly engaging said first and second links (34, 32) adjacent said common pivot (52) so as to limit relative movement therebetween.

* * * * *

UNITED STATES PATENT AND TRADEMARK OFFICE

CERTIFICATE OF CORRECTION

PATENT NO. : 4,429,933

DATED : February 7, 1984

INVENTOR(S) : Eugene K. Sokolowski

It is certified that error appears in the above-identified patent and that said Letters Patent is hereby corrected as shown below:

Column 2, line 58, the referenced numeral "43" should read -- 32 --.

Signed and Sealed this

*Twenty-seventh* Day of *November 1984*

[SEAL]

*Attest:*

GERALD J. MOSSINGHOFF

*Attesting Officer*

*Commissioner of Patents and Trademarks*